US008105221B2

(12) United States Patent
Splane

(10) Patent No.: US 8,105,221 B2
(45) Date of Patent: Jan. 31, 2012

(54) ABDOMINAL EXERCISE DEVICE

(76) Inventor: Robson Splane, Valley Center, CA (US)

( * ) Notice: Subject to any disclaimer, the term of this patent is extended or adjusted under 35 U.S.C. 154(b) by 166 days.

(21) Appl. No.: 12/230,898

(22) Filed: Sep. 8, 2008

(65) Prior Publication Data

US 2010/0062913 A1 Mar. 11, 2010

(51) Int. Cl.
*A63B 21/00* (2006.01)

(52) U.S. Cl. ..... 482/147; 482/71; 482/51; 482/142

(58) Field of Classification Search ..... 482/146, 482/147, 95, 96, 70, 71, 148, 132, 52, 142
See application file for complete search history.

(56) References Cited

U.S. PATENT DOCUMENTS

| | | | | |
|---|---|---|---|---|
| 2,676,015 | A * | 4/1954 | Courtney | 482/142 |
| 4,669,723 | A * | 6/1987 | Arsenian | 482/71 |
| 4,799,475 | A | 1/1989 | Iams et al. | |
| 4,846,465 | A * | 7/1989 | Iams et al. | 482/132 |
| 4,858,918 | A | 8/1989 | Iams et al. | |
| 4,886,050 | A | 12/1989 | Iams et al. | |
| 4,989,860 | A * | 2/1991 | Iams et al. | 482/132 |
| 5,306,223 | A | 4/1994 | Martinez | |
| 5,542,898 | A * | 8/1996 | Wilkinson | 482/142 |
| 5,607,374 | A | 3/1997 | Hesse | |
| 6,440,045 | B1 | 8/2002 | Gaston | |
| 6,485,398 | B1 | 11/2002 | Kreft | |
| 6,626,807 | B1 | 9/2003 | Richmond | |
| 7,156,786 | B1 | 1/2007 | Palmer | |
| 2005/0266964 | A1 * | 12/2005 | Teng | 482/71 |
| 2007/0149370 | A1 | 6/2007 | Brown et al. | |
| 2008/0207406 | A1 * | 8/2008 | Tsai | 482/52 |
| 2009/0163337 | A1 * | 6/2009 | Petrakov | 482/147 |

FOREIGN PATENT DOCUMENTS

WO WO 2008/122143 A1 10/2008

* cited by examiner

*Primary Examiner* — Jerome W Donnelly
(74) *Attorney, Agent, or Firm* — TechLaw LLP

(57) ABSTRACT

An exercise device for the mid to lower body muscles comprising an inclined base, a base frame to support the base a first support bar and a second support bar, the first and the second support bar each having a mounting end and a support end, wherein the first support bar mounting end is pivotably attached to a first pivot point and the second support bar mounting end is pivotably attached to a second pivot point and the first and the second support bar support end are movably mounted on the perimeter of the base such that the first and the second support ends are movable through an arcuate path along the perimeter of the base a first knee pad pivotably attached to the first support bar at the first support bar support end; a second knee pad pivotably attached to the second support bar at the second support bar support end; and a handle attached to the front portion of the base frame. The exercise device may further comprise a crossbar removably attached to the first support bar and removably attached to the second support bar to temporarily immobilize the first and the second support bars relative to each other.

17 Claims, 6 Drawing Sheets

ABDOMINAL EXERCISE DEVICE

TECHNICAL FIELD

This invention relates to exercise equipment.

BACKGROUND ART

Health is always on the forefront of many minds. Unfortunately, in this high technology society efficiency generally dictates how well we maintain our health. Although it is commonly known that diet and exercise are key aspects of maintaining good health, time and money often times supersede our desire to maintain a proper health regimen.

Poor diet and inadequate exercise lead to an uncomfortable lifestyle. Many people are plagued by back pains, in particular, lower back pain. Back pains can be the source of many other discomforts causing problems in walking, sitting, and sleeping. Often times the back pain is due to poor posture, lack of exercise, and lack of stretching causing the back to become stiff and inducing uncomfortable or painful spasms. Stiffness and spasms contribute to the restricted movement of an individual suffering from back pain.

Current exercise devices require lifting of heavy weights while standing or sitting, thereby applying an axial load on the spine and exacerbating bad backs. This can be an additional source of pain. A few devices allow the user to perform middle to lower body exercises in a kneeling position to minimize the axial load; however, these devices are limited in the targeted muscles groups that can be exercised and in the intensity of the exercise. Other exercise devices allow users to conduct exercises in an inclined position; however, these devices are cumbersome, require numerous components, including pulleys and cables, and take up a lot of space. Thus, these devices are inadequate and inefficient.

Therefore, there is still a need for a compact exercise device with minimal components that can allow a user to perform a multitude of exercises while minimizing the axial load on the spine and while being able to increase the intensity of the exercise.

DISCLOSURE OF INVENTION

In general, the present invention is directed towards providing an exercise device that is compact and easy to use, that requires minimal parts, and that can target a variety of muscle groups. In addition, the present invention provides an exercise device designed at minimizing an axial load on the spine while capable of targeting a plurality of muscle groups. Furthermore, the present invention provides an exercise device in which the intensity of the exercise may be adjusted.

In achieving these goals, the exercise device comprises a base; a base frame to support the base and provide an incline; a first support bar and a second support bar, the first and the second support bars having a first and second mounting end, respectively, and a support end, respectively, wherein the first mounting end is pivotably attached to a first pivot point and the second mounting end is pivotably attached to a second pivot point and the first and the second support ends are movably mounted on the perimeter of the base such that the first and the second support ends are movable through an arcuate path along the perimeter of the base; a crossbar removably attached to the first and second support bar to temporarily immobilize the first and the second support bars relative to each other; a first knee pad pivotably attached to the first support bar at the first support end; a second knee pad pivotably attached to the second support bar at the second support end; and a handle attached to the front portion of the base frame.

MODES FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The invention is directed towards an abdominal exercise device 100 that is simple and compact but can target a variety of muscle groups. This exercise device 100 does not require pulleys, cables, resistance bands, weights and other extraneous accessories required by other exercise equipment, although it can be designed in such ways for advanced exercisers. Rather it only requires the weight of the user and the force of gravity. In addition, the exercise device 100 can fold compactly so as to fit in the closet or under a bed.

Figure 1:
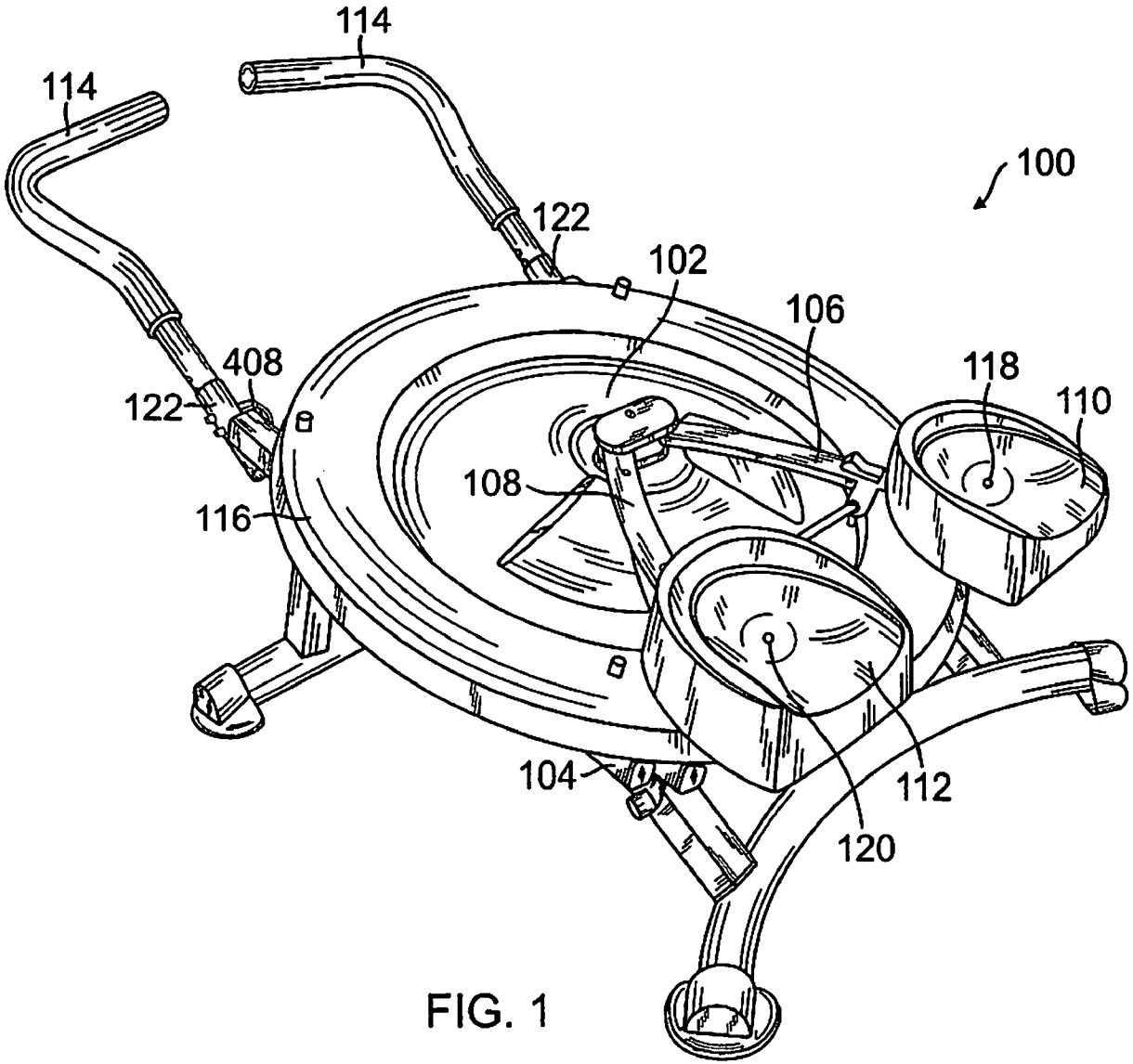
FIG. 1 is a perspective view of an embodiment of the current invention.
Figure 2:
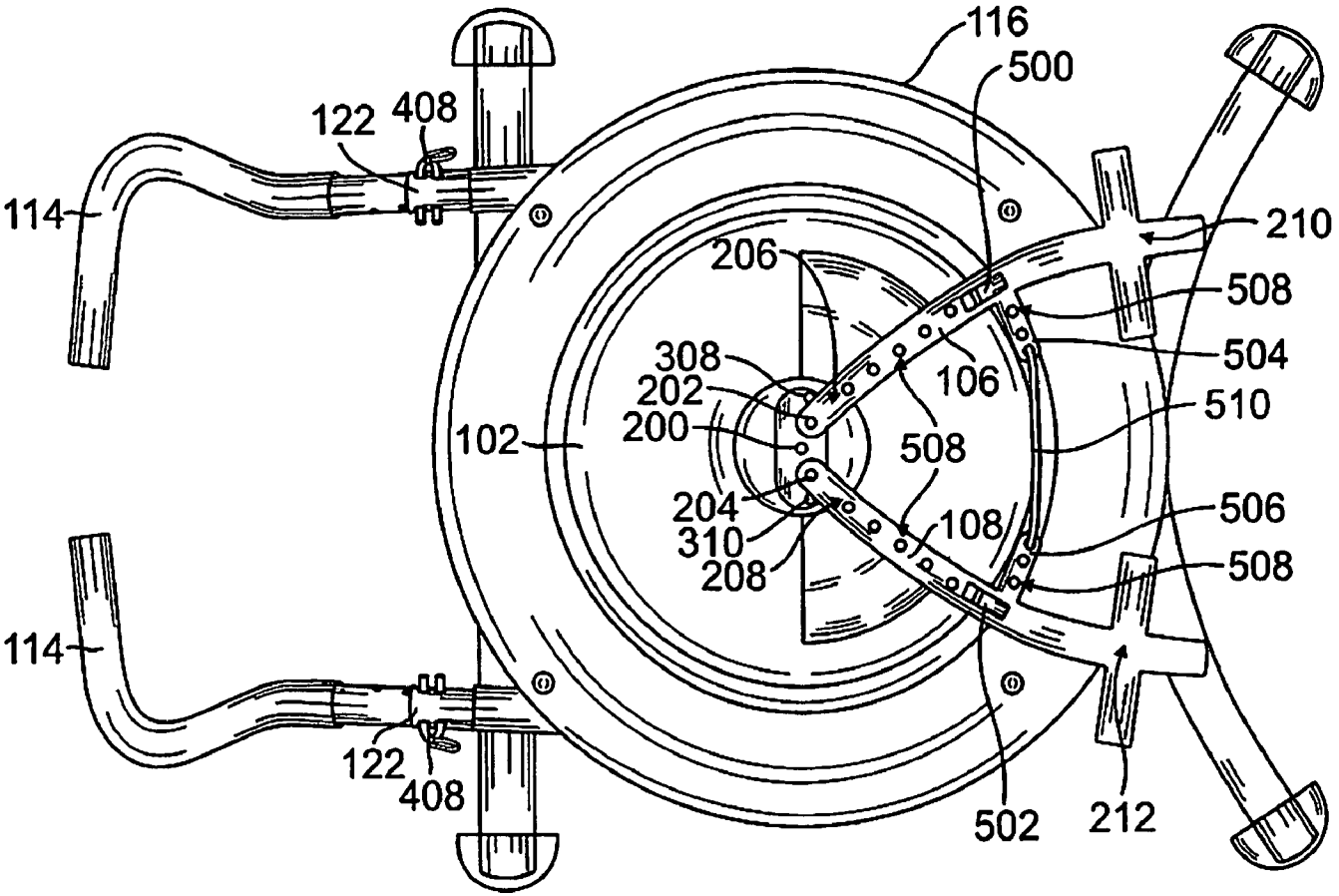
FIG. 2 is a top view of an embodiment of the current invention with the knee pads removed.

As shown in FIGS. 1 and 2, the exercise device 100 comprises a base 102, a base frame 104 to support the base 102, and a pair of knee pads 110, 112. A user places his knees on the knee pads 110, 112 and supports and stabilizes his upper body grasping the base 102, the base frame 104, or handles 114. Using a variety of muscle groups, such as the abdominals, in particular the transverse abdominous and obliques as well as the lower back muscles, the user pivots his lower body from side to side through an arcuate path along the perimeter 116 of the base 102.

The base 102 provides the structural support for the user to perform the exercises. The base 102 has a perimeter 116 and a center 200 and a means for allowing the knee pads 110, 112 to move along the perimeter 116 in an arcuate path. Various means have been contemplated for allowing the knee pads 110, 112 to move along the base 102 in an arcuate path. In some embodiments, the perimeter 116 of the base 102 may have a channel or a groove. For example, the knee pads 110, 112 may slide along the channel or the groove, on bearings or some other slidable or substantially frictionless surface. Alternatively, the perimeter 116 may have a rail on which the knee pads 110, 112 may ride along. In another embodiment, the perimeter 116 may simply be a flat surface and the knee pads 110, 112 stabilized by support bars 106, 108 may slide, glide, or roll along the flat surface. In embodiments utilizing support bars 106, 108, the base further comprises first and second pivot points 202, 204 located bilaterally relative to the center 200.

In the preferred embodiment, the base 102 is circular. The base 102, however, may be any geometric shape such as a square, rectangle, triangle, pie shaped, or the like so long as the base 102 has a large enough surface area for the knee pads 110, 112 to move along a circular path. The base 102 may be made out of any sturdy material providing a smooth surface such as plastic fiberglass, metal, or the like.

Figure 3:
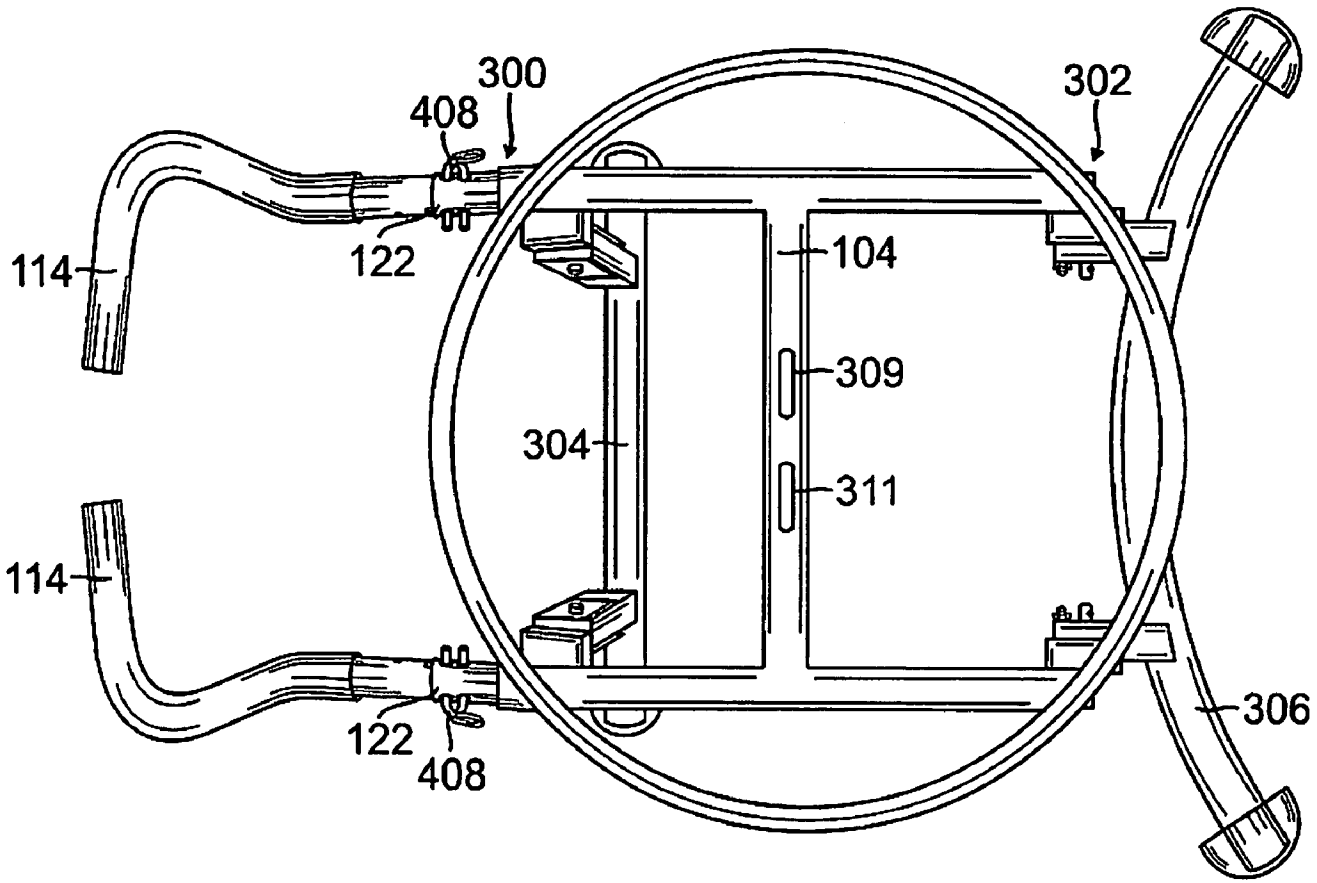
FIG. 3 is a top view of an embodiment with the base removed showing the frame, legs, and handles.
Figure 4:
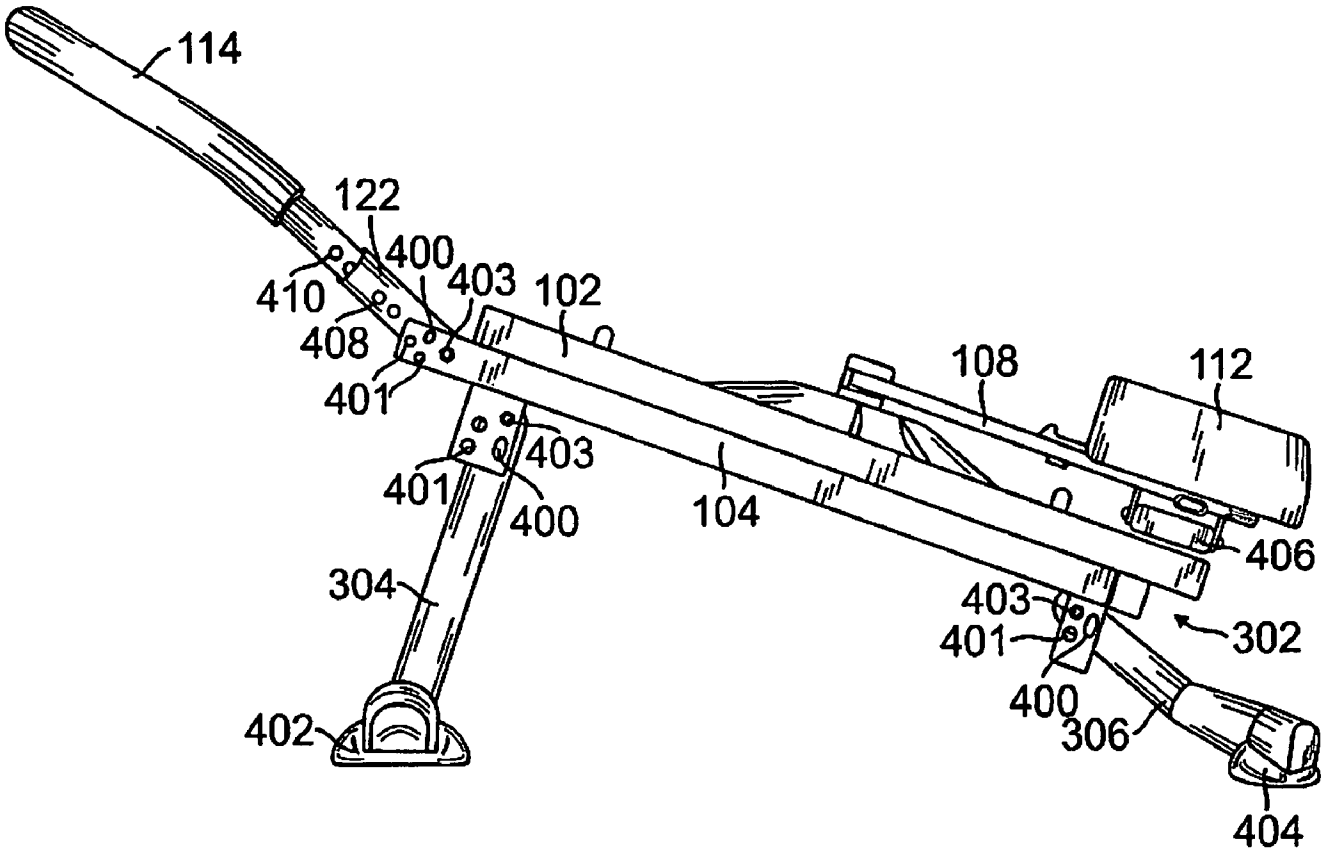
FIG. 4 is a side view of another embodiment of the current invention.

As shown in FIG. 3, the base frame 104 provides the structural support for the base 102. The base frame 104 comprises a front portion 300; a rear portion 302 opposite the front portion 300; a front support 304 attached to the front portion 300; and a rear support 306 attached to the rear portion 302. In some embodiments, the front support 304 is longer than the rear support 306, thereby elevating the front portion 300 above the rear portion 302 and providing an incline for the base 102 as shown in FIG. 4.

In some embodiments, the front support 304 and the rear support 306 are adjustable so as to change the level of incline of the base 102. Thus, the front portion 300 may be higher than the rear portion 302 to create an incline. Alternatively, the rear portion 302 may be higher than the front portion 300 to create a decline. In addition, the front portion 300 and the rear portion 302 may be the same height to create a level surface. Many different ways of adjusting the front and rear support 304, 306 have been contemplated to change the level of incline of the base 102. For example, as shown in FIG. 4, front and rear supports 304, 306 with fixed lengths may be pivotably connected to the front portion 300 and rear portion 302, respectively, of the base frame 104, such that the front and rear supports 304, 306 are pivotable in a forward and rearward direction relative to the base frame 104. A standard locking pin 400 may be used to secure the front and rear supports 304, 306 in various positions by inserting the pin 400 into corresponding holes 401 in the frame 104 and the leg supports 304, 306. Since the lengths of the front and rear supports 304, 306 are fixed, placing the front and rear supports 304, 306 directly below the frame 104 at approximately 90° angles to the frame 104 would provide the base 102 with the greatest height or greatest distance from the ground. Having the front support 304 longer than the rear support 306 would thereby create an incline for the base 102 when the front and rear supports 304, 306 are directly underneath and approximately perpendicular to the frame 104. Pivoting the front support 304 away from the rear support 306 would effectively lower the height of the front portion 300 of the base frame 104, thereby decreasing the level of incline. Similarly, pivoting the rear support 306 away from the front support 304 would lower the height of the rear portion 302, thereby increasing the level of the incline of the base 102.

Alternatively, the front and rear supports 304, 306 may utilize a standard telescoping mechanism to effectively change the incline of the base 102. In some embodiments, the front and rear supports 304, 306 may be pivotably connected to the frame 104 and also be telescoping.

Figure 5:
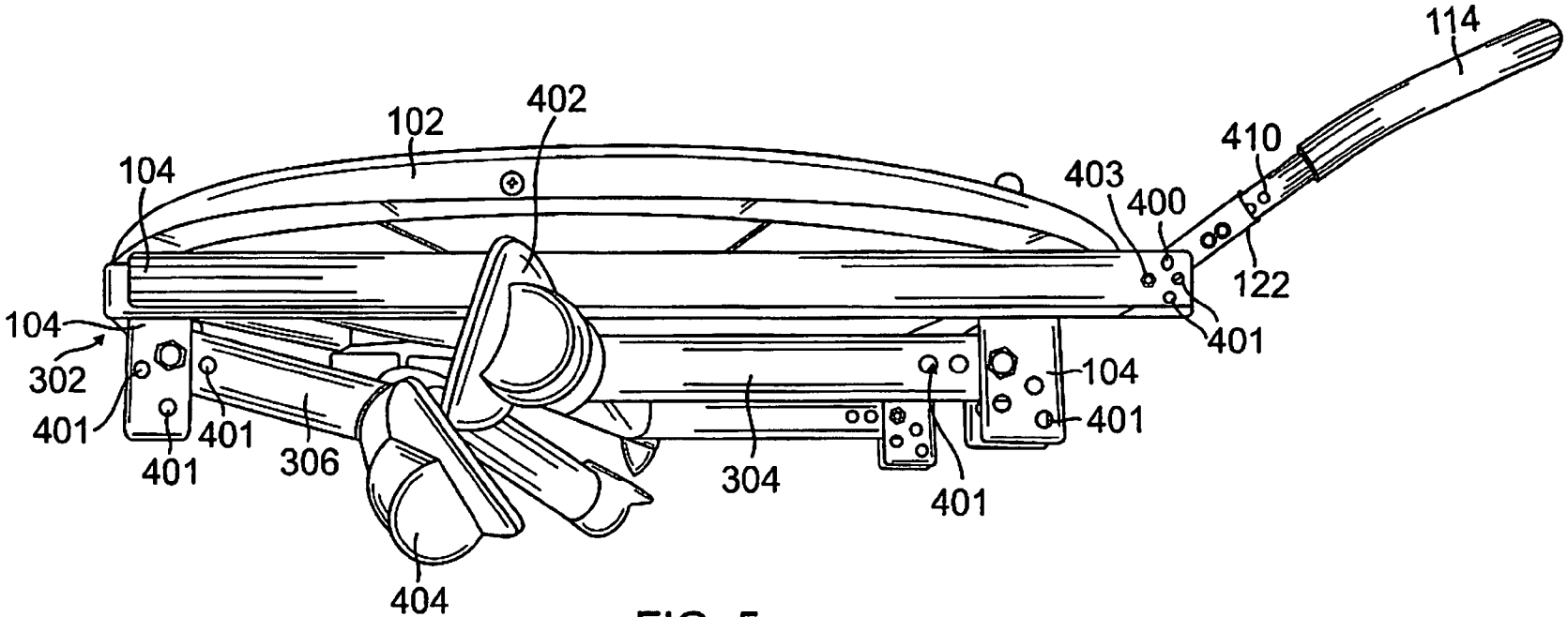
FIG. 5 is a side view of another embodiment of the current invention.
Figure 6:
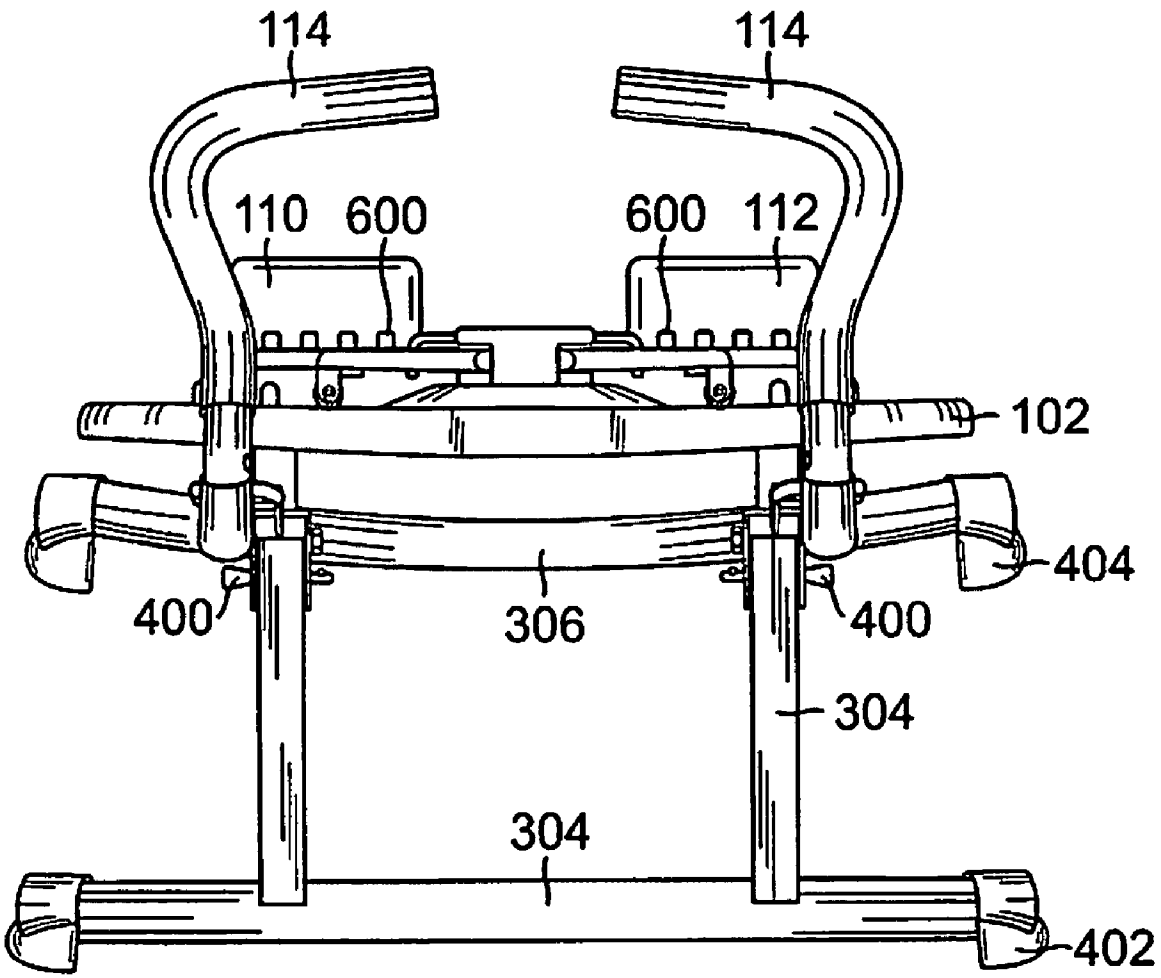
FIG. 6 is a front view of an embodiment of the current invention.

Pivotably connecting the front and rear supports 304, 306 to the frame 104 also provides a means for compactly folding the exercise device 100 for storage or travel. As shown in FIG. 5, the front and rear supports 304, 306 may be pivoted towards each other and folded underneath the base 102 and base frame 104 until the front and rear supports 304, 306 are substantially parallel to the base 102 and base frame 104.

In embodiments in which the support bars 106, 108 provide the means for allowing the knee pads 110, 112 to rotate along a curved or circular path. The first and second support bars 106, 108 each have a mounting end 206, 208 and a support end 210, 212. The mounting ends 206, 208 are pivotably secured to their respective pivot points 202, 204, which are bilateral to the center 200 of the base 102. This fixes one end of the support bars 106, 108 in place while allowing the support ends 210, 212 to move through an arcuate path.

In some embodiments, the mounting ends 206, 208 may share the same pivot point, for example, at the center 200 of the base. In other embodiments, the mounting ends 206, 208 may be adjustable, preferably laterally adjustable as shown in FIG. 2. For example, rather than two bilateral pivot holes 308, 310, the base 102 and base frame 104 may comprise a plurality of bilateral pivot holes 308, 310. This has significant improvements over prior art devices in that the user can select on which pivot hole 308, 310 to mount the leg supports 106, 108, thereby effectively modifying the arcuate path along which the knee pads 110, 112 may traverse. By utilizing various pivot points, the user is able to fine tune his exercise by targeting specific muscle groups or establish more comfortable positions based on the user's size. In another embodiment, the base 102 and base frame 104 may comprise bilateral slots 309, 311 rather than holes 308, 310 to allow the mounting ends 206, 208 to slide to different positions. In embodiments in which the mounting ends 206, 208 of the leg supports 106, 108 are laterally adjustable, the base 102 and base frame 104 are sufficiently large enough to accommodate the widest settings. In other words, with the leg supports 106, 108 mounted on the lateral most position the knee pads 110, 112 can still ride along the perimeter 116 of the base 102.

Each support bar 106, 108 may have a knee pad 110, 112 attached to the top side of the support end 210, 212 and a movement mechanism 406 (only 1 shown) below the knee pad 110, 112 in between the support bar 106, 108 and the base 102 as shown in FIG. 4. Thus, the first support bar mounting end 206 is pivotably attached to the first pivot point 202 and the second support bar mounting end 208 is pivotably attached to the second pivot point 204 and the first and the second support ends 210, 212 are movably mounted on the perimeter 116 of the base 102 such that the first and the second support ends 210, 212 are movable through an arcuate path along the perimeter 116 of the base 102.

The movement mechanisms 406 provide support to the knee pads 110, 112 while allowing the knee pads 110, 112 to slide, glide, roll, or otherwise move along the base 102. For example, the movement mechanism 406 may be a wheel, a roller, a bearing system, such as a ball bearing or roller bearing, a substantially frictionless pad, or the like.

The knee pads 110, 112 provide a comfortable support system for directly supporting the knees during an exercise. The knee pads 110, 112 may be made from any sturdy material that provides some cushioning and comfort to the knees, such as rubber, foam, or the like, during an exercise. The knee pads 110, 112 move along the perimeter 116 of the base 102 in an arcuate path about their respective pivot points 202, 204 located near the center 200 of the base 102. In addition, the knee pads 110, 112 may be pivotable about their own rotation points 118, 120. Having pivotable knee pads 110, 112 may reduce torque or strain on the knees and legs as the lower body pivots around the perimeter 116 of the base 102.

In addition, the first and the second support bars 106, 108 each may comprise a lock 500, 502 to prevent the swiveling or rotating action of the knee pads 110, 112 about their own rotation points 118, 120. The knee pads 110, 112 may have engagement slots 600 into which the locks 500, 502 may slide to prevent pivoting or rotation of the knee pads 110, 112. In addition, the knee pads 110, 112 may have a plurality of engagement slots 600 located in various positions along the knee pads 110, 112 so that the knee pads 110, 112 may be locked at various angles or positions relative to their respective support bars 106, 108. Many other locking mechanisms have been contemplated using resistance, locking pins, pawl and ratchet systems or the like.

In some embodiments, the exercise device has a handle 114. The handle 114 allows the user to support his upper body while performing an exercise. In some embodiments, the handle 114 may be adjustable to change the positioning, the angle, or the length of the handle 114. This provides a wide variety of positions for the user to select the most comfortable position, to select a position providing an appropriate intensity of exercise or to select a position providing the desired type of exercise. The handle 114 may be pivotably attached to the front portion 300 of the base frame 104, similar to that of the front and rear supports, such that the handle 114 is pivotable in an upward, downward, and rearward direction so as to change the angle created between the handle 114 and the base frame 104 as shown in FIG. 4. Thus, the sleeve and/or the handles 114 may be attached to the base frame 104 at a pivot point 403. The sleeve 122 and/or handle 114 and frame 104 may comprise holes 401 into which a locking member 400 may be inserted so as to immobilize the sleeve 122 and/or handle 114 relative to the base frame 104 as shown in FIG. 4.

In some embodiments, the handle 114 may be extendable or telescopic by mounting the handle 114 in a sleeve 122 with a plurality of apertures 408, wherein the handle 114 further comprising a locking pin 400. The handles 114 also comprise a plurality of apertures 408 to correspond with the apertures 410 of the sleeve 122 to increase the length of the handle 114. Telescoping handles allow the exercise device to accommodate users of different sizes as well as different exercises for the same user. In some embodiments, the exercise device comprises a single handle 114 that can support both arms. In other embodiments, the exercise device 100 may have two separate handles 114, one handle 114 for each arm with a gap between the handles 114.

In some embodiment, the exercise device 100 may further comprise a crossbar 510 removably attached to the first and second support bars 106, 108 to temporarily immobilize the first and the second support bars 106, 108 relative to each other. Thus, a user may secure the crossbar 510 across the support bars 106, 108 to conduct exercises with his legs stabilized in the same position relative to each other so that the legs may move together in synchrony. Alternatively, the user may remove the crossbar 510 connection to allow his knees to either move in opposite directions or to move in an alternating manner.

In some embodiments, each leg support 106, 108 may have a tab 504, 506 with a hole 508, wherein the hole 508 is configured to receive the crossbar 510. Each tab 504, 506 may extend approximately perpendicularly from the leg supports 106, 108 towards each other when the leg supports 106, 108 are in a neutral or resting position. The tabs 504, 506 may have a plurality of holes 508 so that the distance between the first knee pad 110 and the second knee pad 112 may be adjusted with a crossbar 510 having a fixed length.

In another embodiment, the leg supports 106, 108 may have the holes 508 configured to receive the crossbar 510. In some embodiments, each leg support may have a plurality of holes 508 along the length of the leg support 106, 108, from the support ends 210, 212 to the mounting ends 206, 208 to allow for the adjustability of the distance between the knee pads 110, 112. Due to the triangular configuration formed by the leg supports 106, 108 and the crossbar 510 (with the mounting ends 206, 208 forming the apex and the crossbar 510 forming the base of the triangle), moving the crossbar 510 closer to the center 200 of the base 102 or towards the mounting ends 206, 208, increases the distance between the knee pads 110, 112 relative to each other.

In another embodiment, a telescoping crossbar may be used to increase or decrease the distance between the knee pads 110, 112.

In some embodiments, the intensity of the exercises may be further increased by attaching resistance mechanisms to support bars 106, 108. The resistance mechanisms may be weights, elastomer members, spring members, viscous members, pneumatic members, or any other means to increase the force required to move the knee pads 110, 112 along the base 102.

Numerous different types of exercises for the lower and upper body are contemplated to target a variety of different muscle groups. A non-exclusive list of exercises that may be performed with this exercise device are described below.

In use, a user may adjust the incline of the exercise device 100, by adjusting the height of the front portion 300, the rear portion 302, or both. The user may also adjust the length, height, and angle of the handles 114 so that the user can maintain a comfortable position. The crossbar 510 may be inserted into the holes 508 to lock or immobilize the knee pads 110, 112 relative to each other. The user may then place his knees on the knee pads 110, 112 and grasp the handles 114 to stabilize his upper body. Using the abdominal and lower back muscles, the user may swing the knees towards his left side and right side in an alternating fashion forcing the knee pads 110, 112 to move along a circular path along the perimeter 116 of the base 102 to perform one type of exercise.

In another type of exercise, the crossbar 510 may be removed. Utilizing various muscle groups of the hips and thighs, as well as the abdomen, sides, and back, the user may then swing both knees to the left and right causing a lateral flexion of the legs relative to the spine. In another type of exercise, the user may alternatingly abduct the left leg to the left and abduct the right leg to the right and return the legs to the neutral position to work the muscles of the hip and inner and outer thigh muscles. In another type of exercise, the user can move the left leg to the left while simultaneously moving the right leg to the right, then bring both legs back towards the center or the neutral position, thereby exercising the hips and thighs.

The versatility of this exercise device also allows the user to exercise his upper body. For example, the user my exercise his chest and triceps by performing modified push-ups with his hands on the handle 114 and his knees on the knee pads 110, 112. In embodiments with two handles 114, the intensity of the push-up may be increased by dipping the chest below the level of the handles into the gap between the handles 114. The versatility of this exercise device also allows for exercising the latissimus dorsi, biceps, and forearms by performing a modified pull-up or a modified lat pull-down. With the crossbar 510 removed the user places his knees on the knee pads 110, 112, grasps the handle 114 and pulls himself partially upwards or forwards by contracting his biceps and latissimus dorsi. The lower body and knee pads 110, 112 follow by crunching or flexing the abdominal muscles and flexing the hip muscles to bring the knees towards the chest laterally through the arcuate path along the perimeter 116 of the base 102. The user can also exercise the triceps and shoulders by elevating the rear portion 302 above the front portion 300 and pushing himself away from the handles 114 while the knees slide backward toward the rear portion 302 of the base 102. The intensity of any of these exercises can be changed simply by changing the incline of the base 102 or by adding resistance mechanisms.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of an exercise device. The invention may comprise a base, a frame, a handle and a pair of knee pads that can move about the base. The knee pads may be attached to support bars, which in turn are pivotably anchored near the center of the base to allow the knee pads to move in an arcuate path. The exercise device can be used for a variety of exercises targeted towards the upper and lower body. The intensity of the exercises may be modified by changing the incline of the base or by adding resistance mechanisms.

What is claimed is:

1. An exercise device, comprising:

a base having a center, an outside and inside end, and a rear and a front end;

first and second support bars, each having an inside end and an outside end, the inside ends respectively coupled to first and second substantially vertical pivot points located substantially proximal to the center of the base but bilaterally offset from the center of the base;

first and second knee supports coupled to the outside ends of the first and second support bars, respectively;

independently rotatable knee pads coupled to the outside ends of the first and second knee supports;

an upper extremity support coupled to the front of the base; and a first base supporting member being positioned at the rear of the base and a second base supporting member being positioned at the front of the base, wherein the first and second knee supports can move along different non-base centered overlapping paths around the outside end of the base.

2. The exercise device of claim 1, wherein the base supporting members are pivotally attached to the base, permitting the base supporting members to be folded, wherein an overall size of the exercise device is reduced when the base supporting members are folded.

3. The exercise device of claim 1, wherein the upper extremity support is pivotally attached to the base.

4. The exercise device of claim 3, wherein a length of the upper extremity support is adjustable.

5. The exercise device of claim 3, wherein the base supporting members and the upper extremity support member are coupled to the base via a frame attached to the base.

6. The exercise device of claim 1, further comprising a low moving friction surface at a bottom of the knee supports, in contact with the outside end of the base.

7. The exercise device of claim 6, wherein the low moving friction surfaces are rollers.

8. The exercise device of claim 1, wherein the first and second support bars are coupled to each other.

9. The exercise device of claim 1, wherein at least one of the knee pads is lockable to prevent rotation of the knee pad.

10. An exercise device, comprising:

a main supporting means for supporting an individual in a kneeling position;

first and second supporting means for controlling motion of knees of the individual, coupled to first and second substantially vertical pivot points located substantially proximal to but bilaterally offset from a center of the main supporting means;

cushioning means for cushioning knees of the individual, coupled to the first and second supporting means, the cushioning means being independently rotatable;

a third supporting means for supporting an upper extremity of the individual, coupled to the main supporting means; and a fourth supporting means for supporting the main supporting means, wherein the first and second supporting means can move along different overlapping paths around the main supporting means.

11. The exercise device of claim 10, wherein the fourth supporting means is pivotally attached to the mains supporting means, permitting the fourth supporting means to be folded, wherein an overall size of the exercise device is reduced when the fourth supporting means is folded.

12. The exercise device of claim 10, wherein the third supporting means is pivotally attached to the main supporting means.

13. The exercise device of claim 10, wherein a length of the third supporting means is adjustable.

14. The exercise device of claim 10, wherein the third and fourth supporting means are coupled to the main supporting means via a frame.

15. The exercise device of claim 10, further comprising low friction means for providing a low friction contact between the first and second supporting means with the perimeter of the main supporting means.

16. The exercise device of claim 15, wherein the low friction means are movable.

17. The exercise device of claim 10, wherein the first and second supporting means are coupled to each other.

* * * * *